United States Patent [19]

Orenstein et al.

[11] Patent Number: 4,801,286

[45] Date of Patent: Jan. 31, 1989

[54] DOLL WITH SIMULATED HAIR GROWTH

[76] Inventors: Henry Orenstein, 1140 Bloomfield Ave., West Caldwell, N.J. 07006; Joseph J. Wetherell, 37 W. 72nd St., New York, N.Y. 10023; Alan Buchwalter, 1020 Race St., Philadelphia, Pa. 19107

[21] Appl. No.: 153,252

[22] Filed: Feb. 5, 1988

[51] Int. Cl.[4] ..... A63H 3/44; A63H 3/36; A63J 19/00

[52] U.S. Cl. ..... 446/319; 446/320; 446/331

[58] Field of Search ..... 446/319, 320, 321, 327, 446/330, 331, 337

[56] References Cited

U.S. PATENT DOCUMENTS

| | | | |
|---|---|---|---|
| Re. 27,267 | 1/1972 | Lilienstern | 446/319 |
| 1,498,950 | 6/1924 | Chinn | 446/319 |
| 3,162,976 | 12/1964 | Beebe et al. | 446/319 |
| 3,670,451 | 6/1972 | Groves et al. | 446/319 |
| 3,694,957 | 10/1972 | Houghton | 446/319 |
| 3,696,551 | 10/1972 | Sklarsky et al. | 446/319 |
| 3,696,552 | 10/1972 | Gunther et al. | 446/319 |
| 3,698,134 | 10/1972 | Amici et al. | 446/319 |
| 3,704,542 | 12/1972 | Suchowski | 446/319 |
| 3,834,071 | 9/1974 | Terzian et al. | 446/319 |
| 4,170,085 | 10/1979 | Luke | 446/319 |

FOREIGN PATENT DOCUMENTS

| | | | |
|---|---|---|---|
| 0104124 | 3/1984 | European Pat. Off. | 446/319 |

*Primary Examiner*—Robert A. Hafer
*Assistant Examiner*—Michael Brown
*Attorney, Agent, or Firm*—Salter & Michaelson

[57] ABSTRACT

A toy doll comprises a doll body including a head portion having an aperture in the upper rear portion thereof, a lock of hair in the aperture and an advancing mechanism which is actuatable for advancing the lock of hair from a retracted first position to an extended second position wherein an increased portion of said lock of hair is exposed. The doll body further comprises first and second arms, and it is constructed so that the first arm is manipulatable for actuating the advancing mechanism and so that the second arm is rotatable for rewinding the advancing mechanism and for simultaneously moving the lock of hair toward the retracted position.

18 Claims, 3 Drawing Sheets

DOLL WITH SIMULATED HAIR GROWTH

BACKGROUND AND SUMMARY OF THE INVENTION

The instant invention relates to toys, and more particularly to a toy doll which is operative with simulated hair growth.

It has generally been found that toy dolls which are operative with actions which simulate the actions of natural persons often have high levels of appeal. For example, it has generally been found that dolls which are operative for performing simulated human actions, such as walking or talking, have relatively high levels of play value. Similarly, it has been found that dolls which are operative for generating simulated tears and dolls which are operative for performing simulated diaper wetting functions are generally relatively popular.

The instant invention provides an effective toy doll which is operative with an amusing and novel form of simulated human activity. More specifically, the instant invention provides a toy doll which is actuatable for operating with simulated hair growth, the toy doll comprising a doll body including a head portion having an aperture in the upper rear portion thereof, and a movable lock of hair which is slidably received in the aperture for movement between a retracted position wherein a predetermined fractional portion of the movable lock of hair is exposed on the exterior of the head portion and an extended position wherein a predetermined greater portion of the movable lock of hair is exposed. The toy doll of the instant invention further comprises an advancing mechanism which is manually actuatable from the exterior of the doll body for advancing the movable lock of hair toward the extended position thereof from the retracted position thereof, the advancing mechanism preferably comprising a gear assembly which is mounted in the doll body and manually actuatable for enabling the movable lock of hair to be automatically adavanced toward the extended position thereof. The advancing mechanism preferably further comprises a tubular sleeve which extends between the gear assembly and the aperture in the head portion of the doll, and the inner end portion of the movable lock of hair is recieved in the tubular sleeve so that it travels therein as the movable lock of hair is moved between the retracted position thereof and the extended position thereof. Further, the advancing mechanism preferably comprises a biasing spring which is received in the tubular sleeve and operative for resiliently biasing the movable lock of hair toward the extended position thereof, and the gear assembly is preferably manually rewindable to retract the movable lock of hair by rotating one of the arms of the doll and manually actuatable by manipulating the other arm of the doll.

Accordingly, during use and operation of the toy doll of the instant invention, the spring-driven gear assembly is manually rewindable to move the movable lock of hair toward the retracted position thereof by rotating one of the arms of the doll. Thereafter the advancing mechanism is manually actuatable by manipulating the other arm of the doll in order to advance the movable lock of hair toward the extended position thereof. Specifically, the advancing mechanism is manually actuatable in order to enable the inner end portion of the movable lock of hair to be advanced in the tubular sleeve by the biasing spring so that the movable lock of hair is advanced toward the extended position thereof.

Devices representing the closest prior art to the subject invention of which the applicant is aware are disclosed in the U.S. Pat. Nos. to Chinn 1,498,950; Lilienstern Re. 27,267; Beebe et al 3,162,976; Groves et al 3,670,451; Houghton 3,694,957; Sklarsky et al 3,696,551; Gunther et al 3,696,552; Amici et al 3,698,134; Suchowski 3,704,542: Terzian et al 3,834,071; and Luke 4,170,085. However, while these references teach a variety of different toy dolls which have adjustable hair pieces or locks of hair, they fail to teach a doll which is manually actuatable for producing simulated hair growth in the doll. More specifically, the references show arrangements which require the lock of hair to be manually pulled from the head of the toy doll to adjust the length thereof. None of the references show an arrangement for automatically advancing a movable lock of hair toward an extended position.

Accordingly, it is a primary object of the instant invention to provide a doll which is manually actuatable for operating with simulated hair growth.

Another object of the instant invention is to provide a toy doll which includes an advancing mechanism for automatically advancing a movable lock of hair from a retracted postion toward an extended position.

Another object of the instant invention is to provide a doll which includes an advancing mechanism for automatically advancing a movable lock of hair toward an extended position wherein the advancing mechanism is manually rewindable by rotating one of the arms of the doll and manually actutable by manipulating the other arm of the doll.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
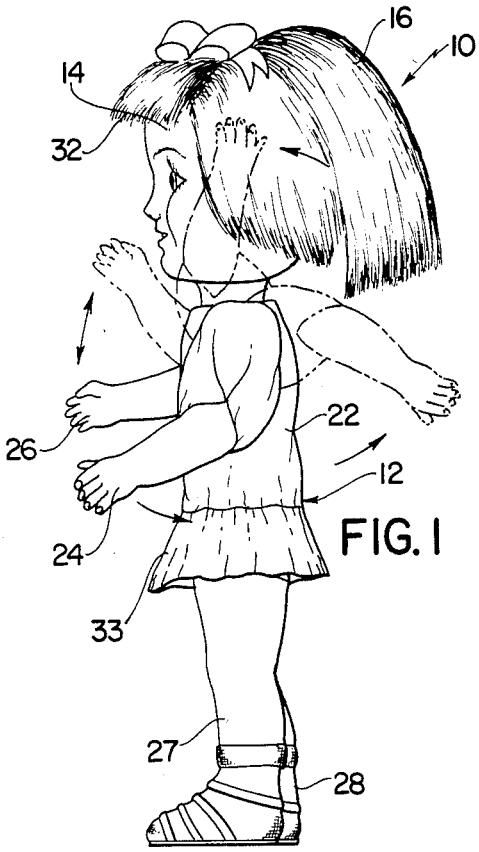
FIG. 1 is a side elevational view of the doll of the instant invention.
Figure 2:
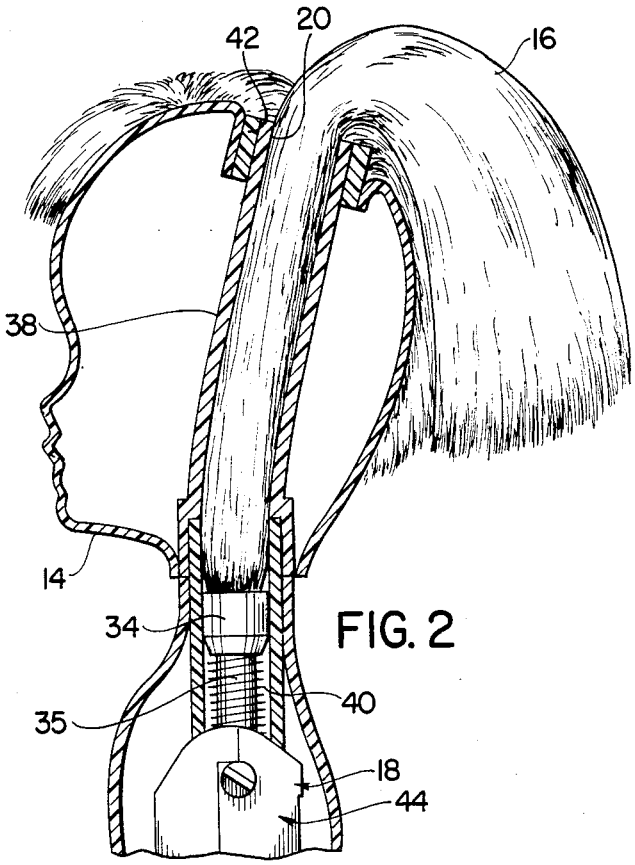
FIG. 2 is an enlarged sectional view of the head portion thereof with the movable lock of hair in the retracted position.
Figure 3:
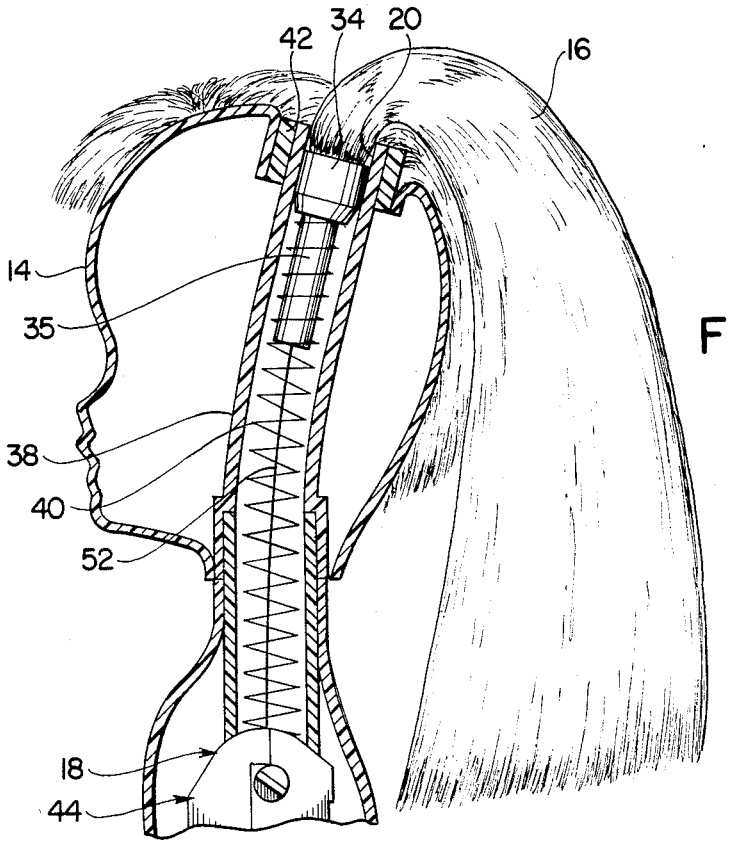
FIG. 3 is a similar sectional view with the movable lock of hair in the extended position.
Figure 4:
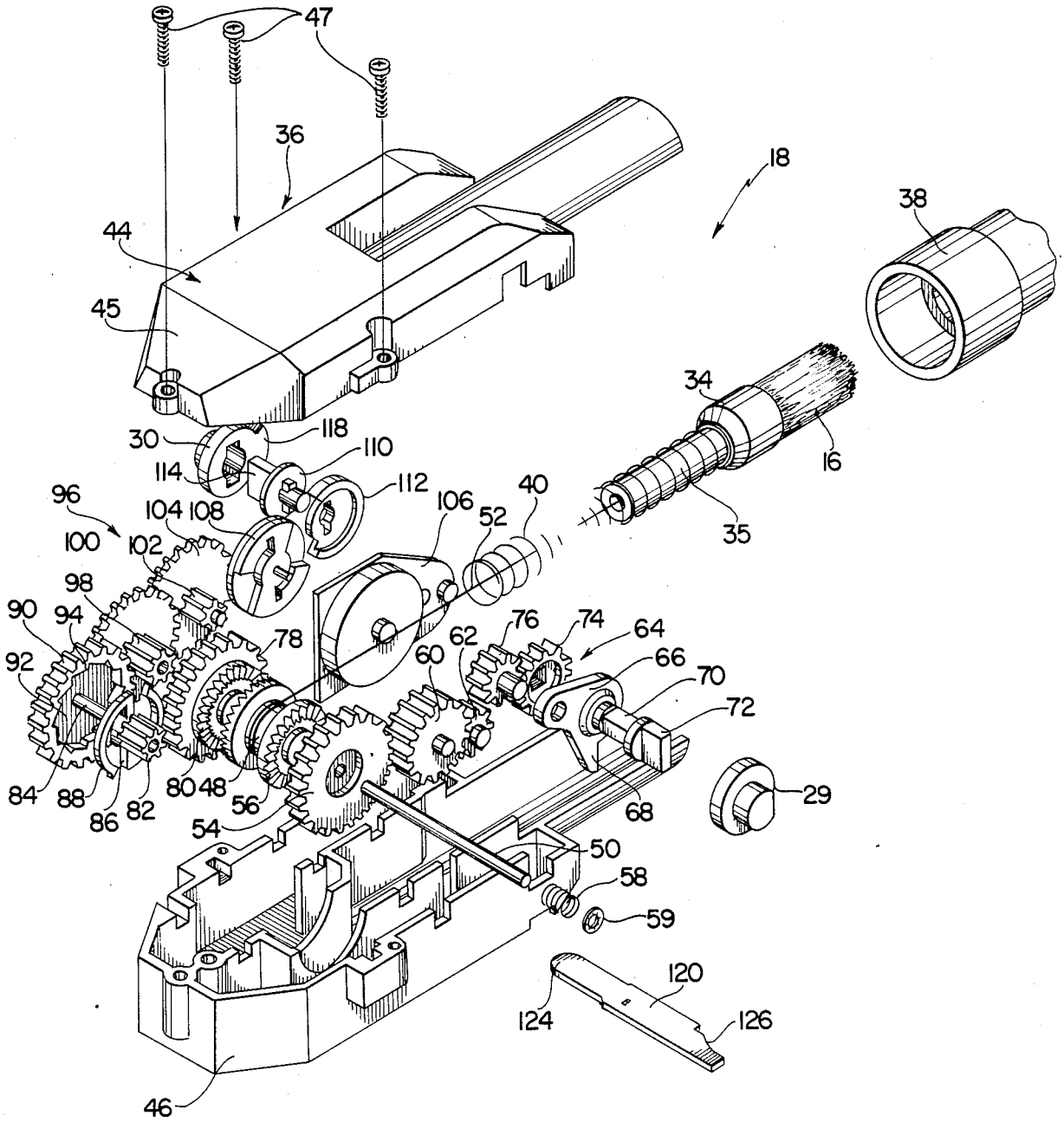
FIG. 4 is an exploded perspective view of the advancing mechanisms of the doll.
Figure 5:
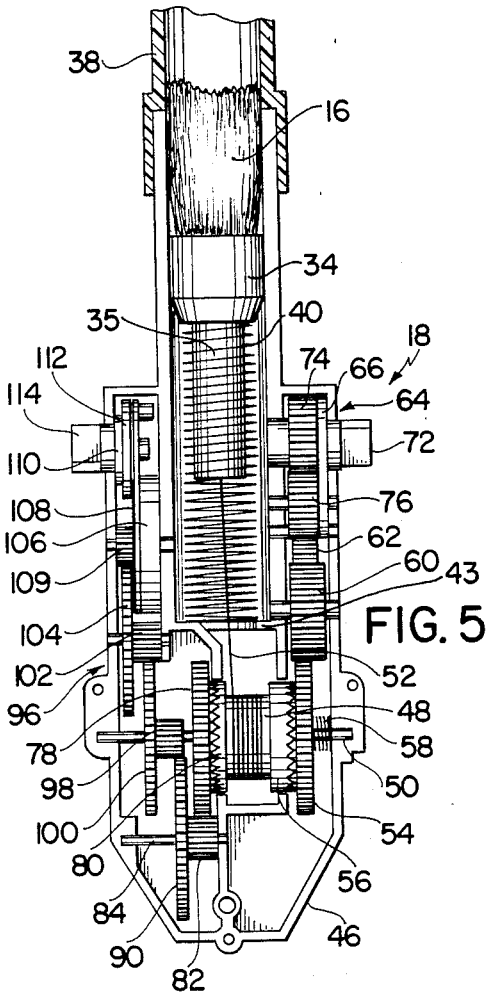
FIG. 5 is a front view of the advancing mechanism with the front cover thereof removed and with the movable lock of hair in the retracted position.
Figure 6:
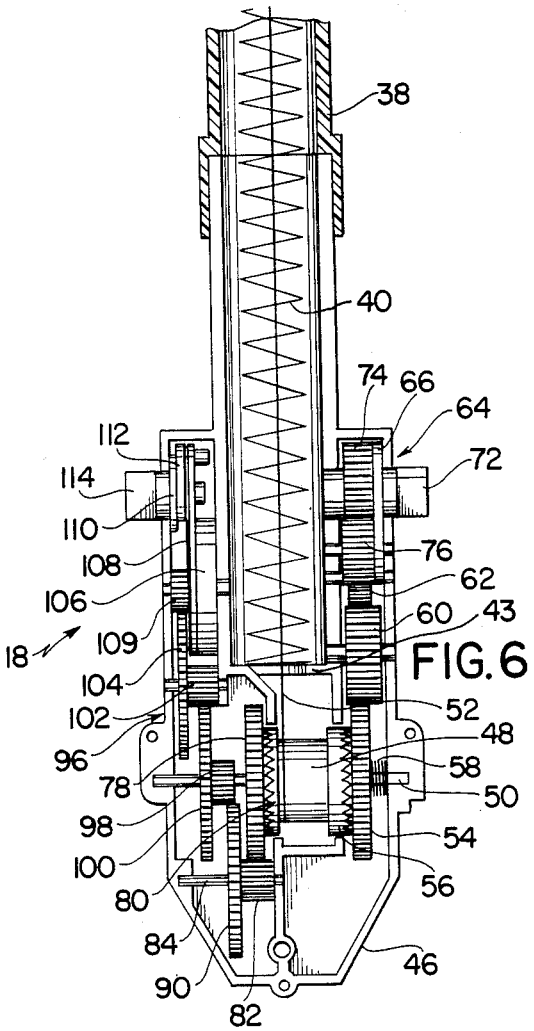
FIG. 6 is a similar view with the movable lock of hair in the extended position.

Referring now to the drawings, the toy doll of the instant invention is illustrated and generally indicated at 10 in FIG. 1, and it comprises a doll body generally indicated at 12 including a head portion 14, a movable lock of hair 16, and an advancing mechanism generally indicated at 18 in FIGS. 2 through 4. The movable lock of hair 16 is assembled with the doll body 12 so that it passes through an aperture 20 in the upper rear portion of the head portion 14, and the advancing mechanism 18 is mounted in the interior of the body 12. The inner end portion of the movable lock of hair 16 is attached to the advancing mechanism 18 in the interior of the body 12, and the advancing mechanism 18 is actuatable for advancing the movable lock of hair 16 from the retracted position illustrated in FIG. 2 toward the extended position illustrated in FIG. 3 in order to provide a simulated hair growth action in the doll 10.

The body 12 is preferably of conventional construction, and it is preferably molded from a suitable rigid or semirigid plastic material in a suitable fleshtone color. The body 12 preferably includes a torso portion 22 to which left and right arms 24 and 26, respectively, and left and right legs 27 and 28, respectively, are pivotably attached. In this connection, the left and right arms 24 and 26, respectively, are secured to left and right mounting discs 29 and 30, respectively, which are rotatably received in apertures in the torso portion 22, and the left and right legs 27 and 28 are secured to the torso portion 22 in a similar manner. The head portion 14 is also preferably pivotably attached to the torso portion 22, and the doll 10 preferably further includes a quantity of fixed hair 32 which is preferably permanently secured to the head portion 14, and suitable doll clothing 33.

The movable lock of hair 16 is preferably of elongated configuration, and it includes a pluraltiy of elongated strands or fibers which are assembled together in generally parallel relation so that the lock 16 is receivable through the aperture 20. The inner ends of the fibers in the movable lock of hair 16 are bunched together and received in an inner end cap portion 34 of a plug 35 which is disposed in the interior of the doll body 12 and operative for attaching the movable lock of hair 16 to the advancing mechanism 18 as will hereinafter be more fully set forth.

The advancing mechanism 18 is illustrated most clearly in FIGS. 4 through 8, and it comprises a gear assembly generally indicated at 36, a tubular sleeve 38, and a biasing spring 40. The gear assembly 36 is mounted in the interior of the torso portion 22 of the body 12, and the tubular sleeve 38 extends from the gear assembly 36 to the upper rear portion of the head portion 14 where the sleeve 38 defines the aperture 20. The tubular sleeve 38 is dimensioned to fit closely around the movable lock of hair 16 so that it can effectively guide the movable lock of hair 16 toward the aperture 20 when the plug 35 is advanced outwardly in the sleeve 38 despite the inherent flexibility of the movable lock of hair 16. Further, the tubular sleeve 38 is preferably constructed so that it provides a substantially continuous conduit for the movable lock of hair 38 which extends from the gear assembly 36 to the exterior of the head portion 14. A tubular fitting 42 is assembled on the upper end of the sleeve 38, and the fitting 42 is assembled in the head portion 14 as illustrated in FIGS. 2 and 3. The spring 40 is received in the tubular sleeve 38 so that it extends between an inner wall 43 in the gear assembly 36 and the end cap portion 34 of the plug 35 for biasing the movable lock of hair 16 toward the extended position thereof illustrated in FIG. 3. The gear assembly 36 is windable by rotating the right arm 24 of the doll 10 in a counterclockwise direction in order to draw the movable lock of hair 16 toward the retracted position thereof by drawing it inwardly into the tubular sleeve 38, and the gear assembly 36 is actuatable for advancing the movable lock of hair 16 toward the extended position thereof by rotating the right arm 26 to an elevated position.

The gear assembly 36 comprises a split housing 44 including front and rear housing sections 45 and 46, respectively, which are secured together with screws 47 and a plurality of intermeshing gears which are mounted in the housing 44 and cooperate with the spring 40 for advancing and retracting the movable lock of hair 16. More specifically, the gear assembly 36 comprises a spool 48 which is mounted on a shaft 50 in the rear housing section 46 and a cord 52 which is connected to the spool 48 and to the plug 35 and passes through the coil spring 40. The gear assembly 36 further includes a main winding gear 54 which is also mounted on the shaft 50, the main winding gear 54 communicating with one end of the spool 48 through a crown gear assembly 56. A spring 58 is retained on the shaft 50 with a retaining ring 59, and it is operative for normally maintaining the gears in the crown gear assembly 56 in intermeshing engagement so that rotation of the main winding gear 54 is normally communicated to the spool 48, but so that the gears in the crown gear assembly 56 are separable slightly to allow relative slippage therebetween in order to prevent damage to the gear assembly 36 due to overwinding. The gear assembly 36 further comprises a first intermediate winding gear 60 which is rotatably mounted in the rear housing section 46 so that it intermeshes with the main winding gear 54, a second intermediate winding gear 62 which is rotatably mounted in the rear housing section 46 so that it intermeshes with the first intermediate winding gear 60, and a swing gear assembly 64. The swing gear assembly 64 comprises a swing plate 66 having an outwardly extending swing arm 68 thereon, a winding shaft 70 having an outwardly projecting tab 72 on the outer end thereof which is receivable in the left arm mounting disc 29, and first and second swing gears 74 and 76, respectively, on the swing plate 66. The shaft 70 extends through an aperture in the swing plate 66, a first swing gear 74 is mounted on the shaft 70 on the inner side of the swing plate 66, and the second swing gear 76 is rotatably mounted on the swing plate 66 so that is intermeshes with the first swing gear 74. The swing gear assembly 64 is received in the rear housing section 46 so that the outer end of the shaft 70 and the tab 72 project outwardly beyond the housing 44 but so that the swing plate 66 and the first and second swing gears 74 and 76 are disposed in the interior of the housing 44. The swing gear assembly 64 is further mounted in the housing 44 so that the swing arm 68 normally projects outwardly thorugh an aperture (not shown) in the rear wall of the rear housing section 46 but so that the swing arm 68 is engageable from the exterior of the housing 44 for pivoting the swing gear assembly 64 from a first position wherein the second swing gear 76 is in intermeshing engagement with the second intermediate winding gear 62 and a second position wherein the second swing gear 76 is disengaged from the second intermediate winding gear 62. Accordingly, when the swing gear assembly 64 is in the first position thereof, rotation of the shaft 70 is normally communicated to the spool 48 for winding the cord 52 thereon, but when the swing gear assembly 64 is in the second or disengaged position thereof, rotation of the shaft 70 is not communicated to the spool 48, and vice versa.

The gear assembly 36 further comprises a secondary winding gear 78 which is also mounted on the shaft 50 and a second crown gear assembly 80 which provides communication between the secondary winding gear 78 and the opposite end of the spool 48 from the crown gear assembly 56. The crown gears in the second crown gear assembly 80 are normally maintained in intermeshing engagement by the spring 58, and the secondary winding gear 78 is mounted so that it intermeshes with a ratchet drive gear 82. The ratchet drive gear 82 is mounted on a shaft 84 in the rear housing section 46, and it is integrally formed with a ratchet ring 86 comprising a pair of ratchet arms 88. A ratchet gear 90 having a recess 92 on the inwardly facing side thereof is also assembled on the shaft 84, and the ratchet ring 86 is received in the recess 92 so that the ratchet arms 88 are engageable with teeth 94 in the recess 92 for communicating rotation from the ratchet drive gear 82 to the ratchet gear 90 in one direction of rotation but not in the opposite direction. Accordingly, the ratchet ring 86 and the ratchet gear 90 cooperate to prevent the gear assembly 36 from being wound in a reverse direction; and as long as the ratchet gear 90 is maintained in a stationary position, the ratchet ring 86 and the ratchet gear 90 cooperate to prevent the gear assembly 36 from being advanced toward an unwound position.

Further included in the gear assembly 36 is a brake mechanism generally indicated at 96 which is operative for maintaining the ratchet gaer 90 in fixed or nonrotatable relation in order to prevent inadvertent unwinding of the gear assembly 36. The brake mechanism 96 comprises integrally formed first and second brake transmission gears 98 and 100 which are mounted on the shaft 50 so that the first brake transmission gear 98 intermeshes with the ratchet gear 90. The brake mechanism 96 further comprises integrally formed third and fourthe brake transmission gears 102 and 104, respectively, a brake housing 106, a brake plate 108, a brake gear 109, and a brake member 110 having a rubberized gripping element 112 thereon. The third and fourth brake transmission gears 102 and 104, respectively, are mounted in the rear housing section 46 so that the third brake transmission gear 102 intermeshes with the second brake transmission gear 100. An open recess is formed in the outwardly facing side of the housing 106, and the brake plate 108 which is rotatably mounted in the recess in the housing 106 has a substantially flat, smooth, outwardly facing surface thereon. The substantially flat outwardly facing surface on the brake plate 108 is exposed and projects outwardly slightly from the housing 106, and the brake gear 109 which is integrally formed with the brake plate 108 intermeshes with the second brake transmission gear 104. The gripping member 112 is formed in the configuration of an outer cap which covers approximately two thirds of the outwardly facing surface of the brake member 110, and a control tab 114 projects outwardly from the brake member 110. The brake member 110 is rotatably mounted on the outer side of the brake housing 106 so that it is rotatable between a position wherein the gripping member 112 frictionally engages the substantially flat surface of the brake plate 108 and a position wherein the gripping member 112 is disengaged from the brake plate 108. Further, the brake member 110 is mounted so that the control tab 114 projects outwardly from the housing 44 and is received in the right arm mounting disc 30 to enable the brake member 110 to be rotated from the exterior of the housing 44 by manipulating the right arm 28. Accordingly, by rotating the brake member 110 so that the gripping member 112 frictionally engages the surface of the brake plate 108, the brake plate 108 can be maintained in a stationary position; and the since ratchet arms 98 engage the teeth 94 in the ratchet gear 90, inadvertent unwinding of the gear assembly 36 due to the force of the spring 40 is prevented.

Figure 7:
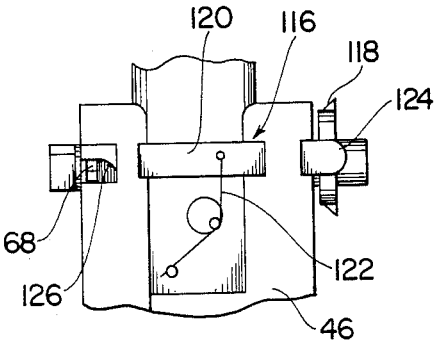
FIG. 7 is a rear view of the actuator portion of the advancing mechanism in an unactuated position.
Figure 8:
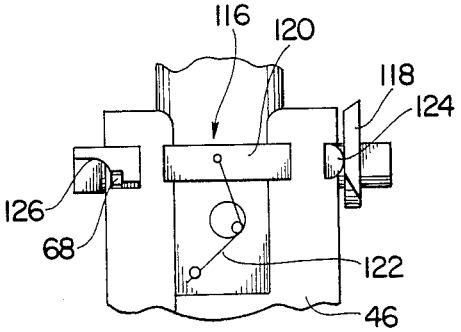
FIG. 8 is a similar view with the actuator portion in an actuated position.

The gear assembly 36 further comprises an actuating mechanism generally indicated at 116 in FIGS. 7 and 8. The actuating mechanism 116 operatively interconnects the brake mechanism 96 and the swing gear assembly 64 in order to assure that the gripping member 112 is in an engaged or gripping position when the spool 48 is rotated to wind the cord 52 thereon and to assure that the second swing gear 76 is disengaged from the second intermediate winding gear 62 when the gripping member 112 is disengaged from the brake plate 108. The actuating mechanism 116 comprises a cam ring 118 which is integrally formed on the inner face of the right arm mounting disc 30, an actuator bar 120 which is slidably mounted on the rear side of the rear housing section 46, and a spring 122. A rounded end 124 is formed at the right-hand end of the actuator bar 120, and a notch 126 is formed in the actuator bar 120 adjacent the left-hand end thereof. The actuator bar 120 is biased toward the right-hand side of the doll 10 with a srping 122, and it is slidably mounted on the rear side of the rear housing section 46. The cam ring 118 extends over an arc of approximately 90° on the inner face of the right arm mounting disc 29, and it is engageable with the rounded end 124 of the actuator bar 120 for camming the actuator bar 120 toward the left side of the doll 10. In this connection, the left end of the actuator bar 120 is formed and positioned so that it is engageable with the swing arm 68 for moving the swing plate 66 to a position wherein the second swing gear 76 is disengaged from the second intermediate transmission gear 62. Further, the cam ring 118 is oriented so that when the gripper member 112 is disengaged from the face of the brake plate 108, the actuator bar 120 is engaged by the cam ring 118 to move the actuator bar 120 to a position wherein it engages the swing arm 68 in order to disengage the second swing gear 76 from the second transmission gear 62. As a result, it is impossible to wind the brake assembly 36 when the gripper member 112 is disengaged from the brake plate 108, but more importantly the shaft 70, the tab 72, and the left-arm mounting disc 29 remain stationary when the gear assembly 36 is advanced toward the unwound position thereof by the spring 40.

Accordingly, for use and operation of the doll 10, the right arm 26 is positioned in a generally downwardly extending position so that the gripper member 112 engages the face of the brake plate 108 and so that the left-hand end of the actuator bar 120 is disengaged from the swing arm 68. The left arm 24 of the doll 10 can then rotated in a counterclockwise direction to wind the cord 52 onto the spool 48. As the cord 52 is wound onto the spool 48, the movable lock of hair 16 is drawn inwardly into the sleeve 38, and the spring 40 is compressed between the end cap 34 and the inner wall 43 in the housing 44. Thereafter, when the right arm 26 is pivoted to an elevated position so that the gripper member 112 is disengaged from the brake plate 108, the actuator bar 120 engages the swing arm 68 to pivot the swing gear assembly 64 away from the second transmission gear 62 so that the spring 40 causes the movable lock of hair 16 to be advanced outwardly from the sleeve 38 toward the extended position illustrated in FIG. 3.

It is seen, therefore, that the instant invention provides an effective and amusing toy doll which has a novel form of action movement. The movable lock of hair 16 can be automatically advanced toward the extended position thereof from the retracted position thereof by the gear assembly 36 in order to provide simulated hair-growth movement in the doll 10. Accordingly, it is seen that the toy doll 10 has a high level of play value and that it therefore represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy doll comprising a doll body including a head portion having an aperture therein in the upper portion thereof, a movable lock of hair slidably received in said aperture for movement between a retracted position wherein a predetermined fractional portion of said movable lock of hair is exposed on the exterior of said body and an extended position wherein a predetermined greater portion of said movable lock of hair is exposed on the exterior of said body, advancing means in said body manually actuatable from the exterior of said body for automatically advancing said movable lock of hair outwardly toward the extended position thereof from the retracted position thereof, and means for automatically retarding the advancement of said movable lock of hair.

2. In the toy doll of claim 1, said head portion having a quantity of fixed hair thereon, said aperture extending through the portion of said head portion covered by said quantity of fixed hair.

3. In the toy doll of claim 1, said advancing means being actuatable for automatically advancing said movable lock of hair toward the extended position thereof.

4. In the toy doll of claim 1, said advancing means being manually rewindable from the exterior of said doll body, said movable lock of hair moving toward the retracted position thereof during rewinding of said advancing means.

5. In the toy doll of claim 4, said doll body including an arm, said advancing means being rewindable by manipulating said arm.

6. In the toy doll of claim 5, said advancing means being rewindable by rotating said arm.

7. In the toy doll of claim 1, said doll body including an arm, said advancing means being actuatable by manipulating said arm.

8. In the toy doll of claim 4, said doll body including first and second arms, said advancing means being actuatable by manipulating said first arm and being rewindable by manipulating said second arm.

9. In the toy doll of claim 8, said advancing means only being rewindable when said advancing means is in an unactuated condition.

10. In the toy doll of claim 9, said advancing means being rewindable by rotating said second arm, said second arm normally remaining substantially stationary when said advancing means is in an actuated condition.

11. In the toy doll of claim 1, said advancing means comprising a gear assembly which is actuatable for enabling said movable lock of hair to be advanced toward the extended position thereof.

12. In the toy doll of claim 11, said gear assembly being manually rewindable, said movable lock of hair moving toward the retracted position thereof during rewinding of said advancing means.

13. In the toy doll of claim 12, said advancing means further comprising a tubular sleeve extending substantially between said gear assembly and said aperture, the inner end portion of said movable lock of hair traveling in said tubular sleeve as said movable lock of hair is moved between the retracted position thereof and the extended position thereof.

14. In the toy doll of claim 13, said advancing means further comprising biasing means in said tubular sleeve resiliently biasing said movable lock of hair toward the extended position thereof and thereby biasing said gear assembly toward an unwound position.

15. In the toy doll of claim 11, said advancing means further comprising biasing means resiliently biasing said movable lock of hair toward the extended position thereof.

16. A toy doll comprising a doll body including a head portion having an aperture therein in the upper portion thereof, a tube extending from said aperture to the interior of said doll body, a lock of hair secured to an end cap, said end cap arranged within said tube and said lock of hair being closely fitting in said tube and extending from said end cap and outwardly through said aperture, said end cap being axially movable in said tube to adjust the length of hair extending outward through said aperture, a spring in said tube for urging said end cap toward said aperture, a cord connected between said end cap and a spool, and means for selectively operating said spool to permit said cord to selectively unwind under the force of said spring to extend said hair, means for automatically retarding the speed of unwinding of said spool, and means for rewinding said spool to retract said hair.

17. A toy doll as specified in claim 16 wherein said means for operating said spool include a brake for selectively engaging said spool.

18. A toy doll as specified in claim 17 including means interconnecting said brake and said rewinding means for permitting said rewinding only when said brake is engaged.

* * * * *

UNITED STATES PATENT AND TRADEMARK OFFICE

CERTIFICATE OF CORRECTION

PATENT NO. : 4,801,286

DATED : Jan. 31, 1989

INVENTOR(S) : Orenstein, Henry; Wetherell, Joseph J.; and Buckwalter, Allan H.

It is certified that error appears in the above-identified patent and that said Letters Patent is hereby corrected as shown below:

On the title page, item [76]-
Change "Alan Buchwalter" to --Allan H. Buckwalter--.

Signed and Sealed this

Twentieth Day of February, 1990

*Attest:*

JEFFREY M. SAMUELS

*Attesting Officer*

*Acting Commissioner of Patents and Trademarks*